US005373640A

United States Patent [19]

Cordeiro, Jr.

[11] Patent Number: 5,373,640

[45] Date of Patent: Dec. 20, 1994

[54] TWEEZER FORK

[76] Inventor: James H. Cordeiro, Jr., 115 Kingman St., Lakeville, Mass. 02346

[21] Appl. No.: 148,644

[22] Filed: Nov. 8, 1993

[51] Int. Cl.[5] ..... A47J 43/28

[52] U.S. Cl. ..... 30/142; 30/322; 294/99.2

[58] Field of Search ..... 30/137, 142, 322, 1; 294/99.2, 100; D7/653; D28/55

[56] References Cited

U.S. PATENT DOCUMENTS

D. 107,410 12/1937 Eliopoulos ..... 30/142 X
D. 127,729 6/1941 Tonelli ..... 30/142 X

FOREIGN PATENT DOCUMENTS 810803 8/1951 Germany ..... 30/322
894155 10/1953 Germany ..... 30/322
17401 8/1901 United Kingdom ..... 30/322

*Primary Examiner*—Richard K. Seidel
*Assistant Examiner*—Hwei-Siu Payer
*Attorney, Agent, or Firm*—John P. McGonagle

[57] ABSTRACT

An eating utensil comprised of a combination of a tweezer device and fork. To attain this, the present invention provides a utensil which has a first handle member and a second handle member which are mirror images of each other. The first and second handle members are attached at a proximal end and bent away from each other and then parallel to one another such that there is a space in between the handle members. The distal end of each handle member terminates in at least two prongs. The innermost prongs provide contact surfaces for firmly grasping food morsels in a tweezer mode. The tines also permit the utensil to be used as a traditional fork.

3 Claims, 2 Drawing Sheets

TWEEZER FORK

BACKGROUND OF THE INVENTION

This invention relates generally to eating utensils, and more particularly to a utensil that is a combination of a tweezer device and a fork.

Picking up small morsels of food with a traditional fork, spoon or knife can be difficult due to the relative size differential of traditional utensils and the object to be picked up. A small morsel may be of a size smaller than the space between the prongs of a traditional fork and of a shape such that a spoon could not be used. The morsel may be round and roll off the fork or spoon, or be wet and slippery and difficult to hold or cut because of a sauce or liquid coating.

Picking up or grasping small things from a plate such as fish bones can be very difficult, because traditional utensils do not allow a user to firmly grasp the small fish bone that needs to be removed. The fish bone could more easily be removed if an eater could firmly grasp an end of the bone and pull it from the fish meat. Instead, a user ends up pushing or sliding the fish bone away from the more desirable remaining fish.

Removal of seeds from fruits or other vegetables can also be difficult with traditional utensils, especially small seeds such as those found in apples, watermelon or peppers. In addition to the removal of undesirable food morsels, an eater can also have a difficult time selecting small desirable morsels of food from a larger portion of food with traditional utensils.

Foods such as spaghetti, are difficult to eat with traditional utensils and can more easily and with less mess be eaten if an eater is better able to firmly grasp the noodles. Firmly grasping the noodles provides better control and less mess in eating as opposed to wrapping noodles around a traditional utensil or some other noodle eating method.

Some foods are difficult to cut because it is hard to hold these foods in a steady position. This may also be due to an oily sauce or coating. Attempting to hold foods of this nature while cutting with traditional utensils, can create a mess on an eaters clothes, table or floor, or injure an eater with a knife or fork that slips from an unsteady food grasping position.

If a separate utensil such as a tweezer or pick were used to remove the undesirable morsel of food from the wanted morsel, the user would then have to set down the tweezer or pick and grasp the traditional fork or spoon to continue eating the food.

Prior art attempts to solve these problems include U.S. Pat. Nos. 5,056,173 and 4,809,435. These patents both disclose eating utensils which are combination fork and chopsticks utensils. Both disclose a conventional fork head with a chopstick assembly protruding from said head in place of a conventional fork handle. In both cases, should the eater wish to use the chopsticks portion instead of the fork portion of the utensil, the utensil must be put down, repositioned and regripped before utilization of the utensil can be resumed. This is likewise the case should the eater wish to use the fork portion of the utensil instead of the chopsticks portion of the utensil.

SUMMARY OF THE INVENTION

In view of the foregoing disadvantages inherent in the known types of devices now present in the prior art, the present invention provides a combination tweezer device and fork, i.e., a tweezer fork. This combination will permit an eater to discriminately pick a small portion of unwanted, undesirable or very desirable morsel of food from a larger portion of food. The eater can then continue eating with the same utensil, the tweezer fork, without setting down a utensil. Once the food morsel is removed with the tweezer device, the tweezer fork can be used as a traditional fork. The combination of tweezer device and fork also allows a user to more safely grasp a slippery or difficult to hold food object while cutting, thereby increasing the safety of the culinary arts.

As such, the general purpose of the present invention, which will be described subsequently in greater detail, is to provide a new and improved food utensil which will function as a traditional fork as well as permit the firm grasping of slippery food, removal of unwanted morsels or the selection of very desirable morsels without the inconvenience of having to handle a multitude of utensils. The present version of this invention will also function as a traditional fork.

To attain this, the present invention provides a utensil which has a first handle member and a second handle member which are mirror images of each other. The first and second handle members are attached at a proximal end and bent away from each other and then parallel to one another such that there is a space in between the handle members. The distal end of each handle members terminate in at least two prongs. The innermost prongs provide the contact surfaces for firmly grasping food morsels with the tweezer device.

The invention also incorporates a support band which provides a structure for preventing the handle members from separating from each other to a position greater than a substantially parallel orientation and restricts movement of the handle members to one plane only.

In this embodiment of the invention, the handle members are manufactured from a flexible material such that when a user pushes the first and second handle members together from a normally open first position to grasp an object or food morsel, the first and second contact prongs of the tweezer device move together, contact, and firmly grasp the object or food morsel in the second position. Upon release of the first and second handle members, the first and second handle members return to the normally open first position and the food morsel is released. The tweezer fork can then be used as a traditional fork.

Another object of this invention is to provide a way for eaters to easily and firmly grasp a small food morsel for selection or removal from a larger food and continue eating. If the small morsel was selected with the tweezer device it could then be inserted into the mouth or set aside. If the tweezer device was used to remove an unwanted morsel, the eater could continue to eat the remaining food using the tweezer fork as a traditional fork, without picking up another utensil.

A further object of this version of the invention is to provide a way to pick up and eat small food morsels or difficult to hold foods with less mess. The tweezer device can be used to firmly grasp the food, and this decreases the likelihood of dropping the food morsel on the table, floor or clothing of the eater. A further objective of this invention is to enhance the culinary safety area. If eaters can firmly grasp difficult to hold food morsels, this reduces the risk of eaters being accidently cut or stabbed by a flailing knife or fork which has slipped from a difficult to hold food morsel.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF THE INVENTION

Figure 1:
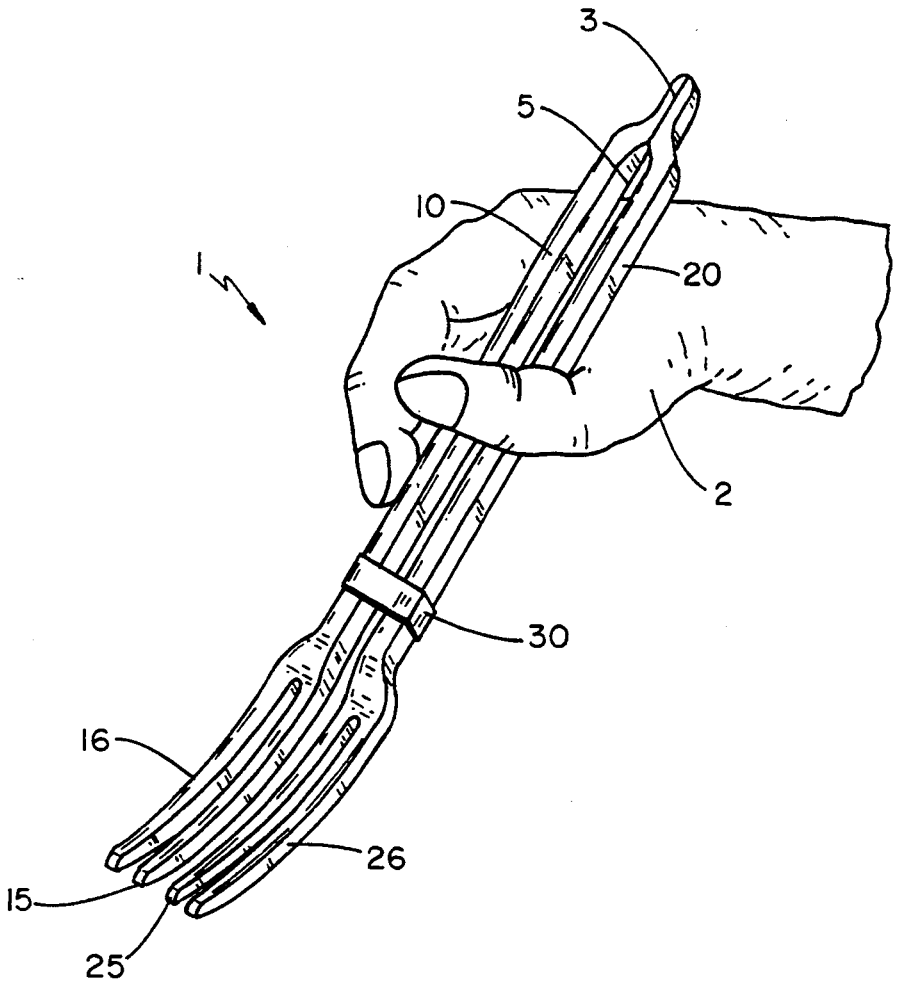
FIG. 1 is a perspective view of the invention showing the invention held in the hand of user.

Referring to the drawings in detail wherein like elements are indicated by like numerals, there is shown an embodiment of the invention 1 incorporating a tweezer fork. The fork 1 has a first handle member 10 and a second handle member 20 in a primarily parallel orientation. Each handle 10, 20 has proximal ends 11, 21 and distal ends 12, 22, respectively. The handle proximal ends 11, 21 are joined to each other, forming a junction 3. The handle portions 13, 23 near to the respective handle proximal ends 11, 21 are bent divergently away from the junction 3. The remaining handle portions 14, 24 extending from the proximal portions 13, 23 to the distal ends 12, 22 are straight sections and are bent back toward each other so that the longitudinal axis of the remaining handle portions 14, 24 are parallel to each other. The plane defined by the two remaining handle portions 14, 24 is defined as the plane of the tweezer fork 1.

The distal ends 12, 22 of each handle member 10, 20 terminate in at least one tine 15, 25, defined as the first tine 15, 25 for each handle member 10, 20. The longitudinal axis of each first tine 15, 25 is substantially coincident with the longitudinal axis of the remaining handle portions 14, 24. A second tine 16, 26 is attached to each handle member distal end 12, 22 by a connecting member 17, 27. The second tine 16, 26 of a given handle member 10, 20 is attached to its handle member distal end 12, 22 so that a handle member's second tine 16, 26 is positioned in parallel to said handle member's first tine 15, 25, and along the side of the first tine 15 or 25 opposite to the other handle member's first tine 25 or 15, respectively. The tines 15, 16, 25, 26 are concavely cured and are offset with respect to the plane defined by the handle portions 14, 24. The tines 15, 16, 25, 26 are substantially the same length, and parallel to each other. Tines 15, 25 are separated by a predetermined distance that is different than a predetermined distance separating tines 15, 16 and tines 25, 26. The tweezer fork 1 of the present invention may have any number of tines, but the preferred embodiment has a total of four.

Each handle member 10, 20 is made of a sturdy but resilient material such as spring steel. Plastics or wood materials could also be used. The separation between the handle members 10, 20 and their corresponding first tines 15, 25 results in a longitudinal space 5. A support band 30 circumferentially surrounding the first handle member 10 and the second handle member 20 in a location along the remaining portions 14, 24 limits the maximum separation forming the space 5. The support band 30 prevents the first handle member 10 and the second handle member 20 from moving farther away from each other than a desired normally open position. The support band 30 allows movement in the fork plane longitudinal space 5 only.

The first tines 15, 25 are also termed the first contact prongs when the tweezer fork 1 is used in a tweezer mode. The first contact prongs 15, 25 are parallel to one another in the normally open position. In the tweezer mode a user's hand 2 would grasp the tweezer fork 1 by the handle members 10, 20 and urge the first and second handle members 10 and 20 toward one another until the first contact prongs 15, 25 of each handle member 10, 20 contact the food morsel (not shown) or object to be picked up or grasped. The food morsel could then be disposed of or eaten. When the first and second handle members 10, 20 are released, the resilient material in the handle members 10, 20 and the formation of the junction 3 cause the handle portions 10, 20 to return to a normally open first position. A user could then utilize the tweezer fork 1 as a traditional fork and the eater could continue eating the food.

Figure 2:
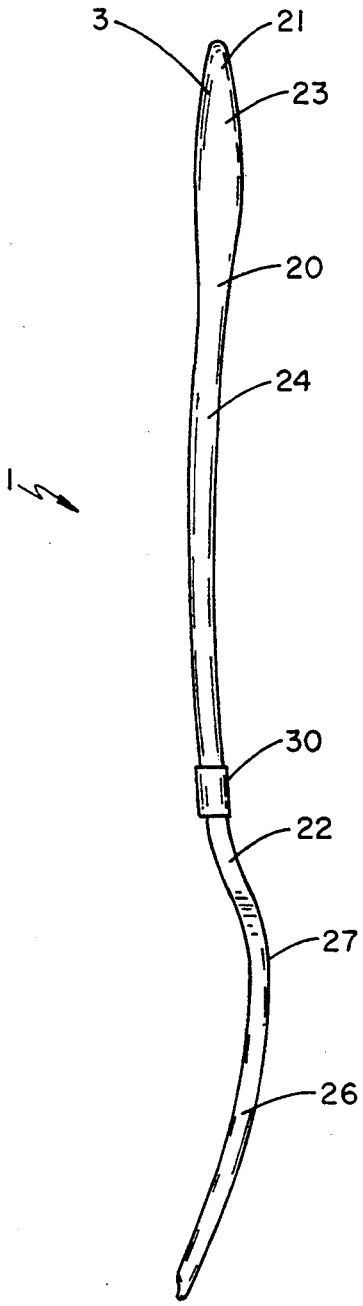
FIG. 2 is a side elevational view of the invention.
Figure 3:
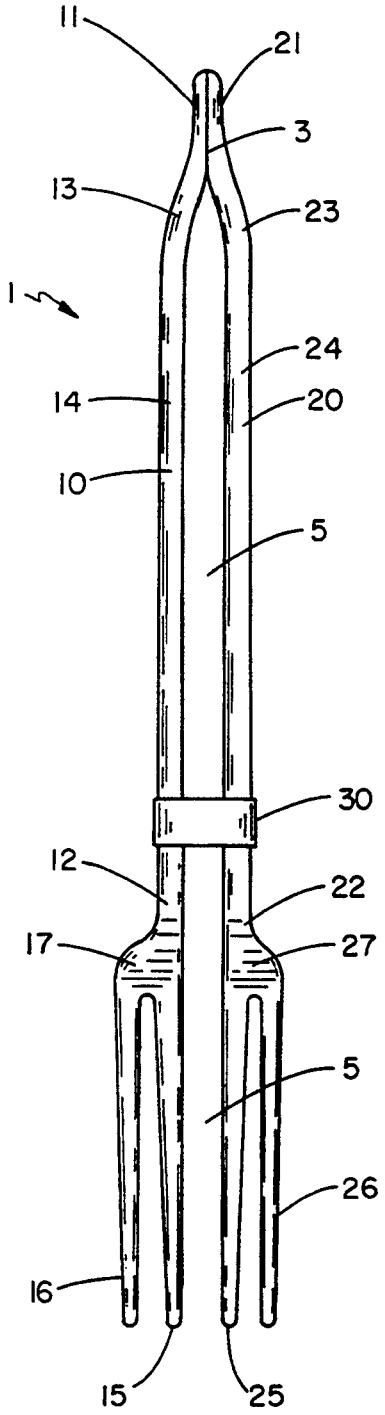
FIG. 3 is a front elevational view of the invention.

As may be seen from FIG. 2 although the first and second handle members 10, 20 are substantially parallel to one another and substantially straight, the tweezer fork 1 may be curved longitudinally in parallel such that the tines 15, 16, 25, 26 are curved about the fork plane in the manner of a traditional fork.

It is understood that the above-described embodiment is merely illustrative of the application. Other embodiments may be readily devised by those skilled in the art which will embody the principles of the invention and fall within the spirit and scope thereof.

I claim:

1. A tweezer fork eating utensil, comprising:

a first handle member having a distal and a proximal end;

a second handle member having a distal and a proximal end, wherein said handle members are mirror images of each other, and wherein said first and second handle members are in a primarily parallel orientation and are attached at their proximal ends forming a junction;

said handle members having proximate handle portions, near to the respective handle proximal ends, which are bent divergently away from the junction, and having generally straight remaining handle portions extending from said proximal handle portions to the distal ends, said remaining handle portions being bent back toward each other so that the longitudinal axes of the remaining handle portions are parallel to each other, wherein a plane defined by the remaining handle portions is defined as the plane of said eating utensil;

a plurality of tines extending out from said distal ends, wherein the distal end of each handle member terminates in at least one tine, defined as a first tine for each handle member, the longitudinal axis of each first tine being substantially coincident with the longitudinal axis of its respective handle portion, wherein a second tine is attached to each handle member distal end by a connecting member, said second tine of a given handle member being attached to its handle member distal end so that a handle member's second tine is positioned in parallel to said handle member's first tine and along the side of the first tine opposite to the other handle member's first tine, said tines being concavely curved and offset with respect to said plane of said eating utensil;

wherein said tines are substantially the same length and parallel to each other, wherein said first tines are separated by a predetermined distance that is different than a predetermined distance separating the first and second tines of each handle member; and a support band circumferentially surrounding the first handle member and the second handle member at a location along the remaining handle portions, said band adapted to prevent said handle members from separating from each other to a position greater than a substantially parallel orientation and restricting movement of the handle members to one plane only.

2. An eating utensil as recited in claim 1, wherein:

each handle member is made of a sturdy but resilient material.

3. An eating utensil as recited in claim 2, wherein:

the separation between the handle members and their corresponding first tines results in a longitudinal space.

* * * * *